US006526612B1

(12) United States Patent
Zarrella

(10) Patent No.: US 6,526,612 B1
(45) Date of Patent: Mar. 4, 2003

(54) HAND-SUPPORTED HEADREST PILLOW

(76) Inventor: Carmine Zarrella, 124 Kenilworth Ave., Staten Island, NY (US) 10312

( * ) Notice: Subject to any disclaimer, the term of this patent is extended or adjusted under 35 U.S.C. 154(b) by 0 days.

(21) Appl. No.: 09/638,438

(22) Filed: Aug. 14, 2000

(51) Int. Cl.[7] ..... A47G 9/00
(52) U.S. Cl. ..... 5/636; 5/646
(58) Field of Search ..... 5/636, 632, 646; 2/161.6, 18, 19, 20; 128/26, 260, DIG. 15

(56) References Cited

U.S. PATENT DOCUMENTS

| | | | | |
|---|---|---|---|---|
| 8,065 A | | 4/1851 | Towers et al. | |
| 310,257 A | | 1/1885 | Cowan | |
| 2,850,342 A | | 9/1958 | Robinson | |
| 3,496,573 A | * | 2/1970 | Kuchar et al. | 2/161.6 |
| 4,393,520 A | | 7/1983 | Koch | 2/16 |
| 4,711,445 A | * | 12/1987 | Whitehead | 482/49 |
| 5,161,760 A | | 11/1992 | Terbrack | 248/118 |
| 5,219,340 A | * | 6/1993 | Seneca | 401/201 |
| 5,439,192 A | | 8/1995 | King | 248/118 |
| 5,730,711 A | | 3/1998 | Kendall et al. | 602/64 |
| 5,771,901 A | | 6/1998 | O'Brien | 128/878 |

OTHER PUBLICATIONS

Thai Puff Manufacturing Co., Ltd. Jan. 25 1999, pp. 1–2.*

* cited by examiner

*Primary Examiner*—Lynne H. Browne
*Assistant Examiner*—Fredrick Conley
(74) *Attorney, Agent, or Firm*—Cohen, Pontani, Lieberman & Pavane

(57) ABSTRACT

A hand-supported headrest pillow for providing a convenient and compact headrest. The pillow includes a cushion dimensioned for seating about the palm of a user's hand. A strap attached to the cushion is provided for securing the cushion to and against a user's palm so that, when so-positioned, the user's head can be rested against the cushion. In an alternate embodiment, the strap is replaced by one or more sleeves or sheaths for accommodating insertion of one or more of the user's fingers to secure the cushion to and against the user's hand.

10 Claims, 2 Drawing Sheets

HAND-SUPPORTED HEADREST PILLOW

BACKGROUND OF THE INVENTION

1. Field of the Invention

The present invention pertains to personal comfort devices and, more particularly, to a portable cushion or pillow headrest.

2. Description of the Related Art

Numerous personal comfort items exist for providing comfort to various parts or areas of a user's body. One entire category of such items are those specifically designed for use in conjunction with a user's head, such as pillows or cushions, headrests, etc. A problem with such heretofore known items is that most are not compact or portable and, thus, are not convenient for use in certain environments such as by passengers on trains, buses or automobiles. Oftentimes such passengers will attempt a comfortable position in which to fall asleep while in transit and, in so-doing, will seek a suitable and comfortable nearby surface or position for resting one's head. However, and particularly for commuter buses and trains which are not necessarily designed for passenger comfort but more for efficiency in transporting as many commuters as possible, a comfortable headrest is typically not available. Thus, passengers often rest their heads against a hard surface such as a window (if available) or against their hands while supporting their elbows on an adjacent arm rest or the like. None of these positions provide optimal comfort.

Recognizing the need for commuter comfort, several prior art devices have been marketed in the nature of inflatable pillows which, when deflated, are compact in form for convenient transport, as in a briefcase etc. To use such pillows, they must first be inflated by a user blowing air through an inlet valve whereupon, in one common form, the pillow can then be placed in partially encircling relation around the user's neck to provide head support. However, the need for inflating such devices makes them less than desirable and, in addition, they permit the user's head to be maintained in only a single, predetermined position namely, with the user sitting upright and the user's head facing forward.

SUMMARY OF THE INVENTION

The present invention is directed to a pillow or cushion for providing support and comfort to a user when a user's head is resting in a variety of positions and orientations, including propped against the user's hand. The pillow is compact in size and configured for seating across a user's palm so that when the pillow is, for example, placed between the user's palm and the user's head, a comfortable headrest is provided. The pillow includes an integral securing means for releasably securing the pillow to the user's hand so that the pillow will maintain its position when the user's head is partially or orientationally shifted or lifted from the pillow. The securing means is preferably a single-piece strap formed of an elastic band so that it will accommodate different hand sizes, but may also be a two-piece strap that can be selectively adjusted, such as by engagement of hook and loop fasteners. Alternatively, the securing means may include finger sleeves or sheaths for accommodating insertion of individual ones of a user's fingers to position the pillow in its intended manner across a user's palm.

In another embodiment, a sound transducer such as a speaker is incorporated within the pillow cushion. The speaker is capable of being electrically connected to an audio source such that when a user's head is resting against the pillow and the user's ear is positioned proximate the speaker, the user will hear sound emanating from the speaker.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the figures, wherein like reference characters denote similar elements throughout the several views.

DETAILED DESCRIPTION OF THE PRESENTLY PREFERRED EMBODIMENTS

Figure 1:
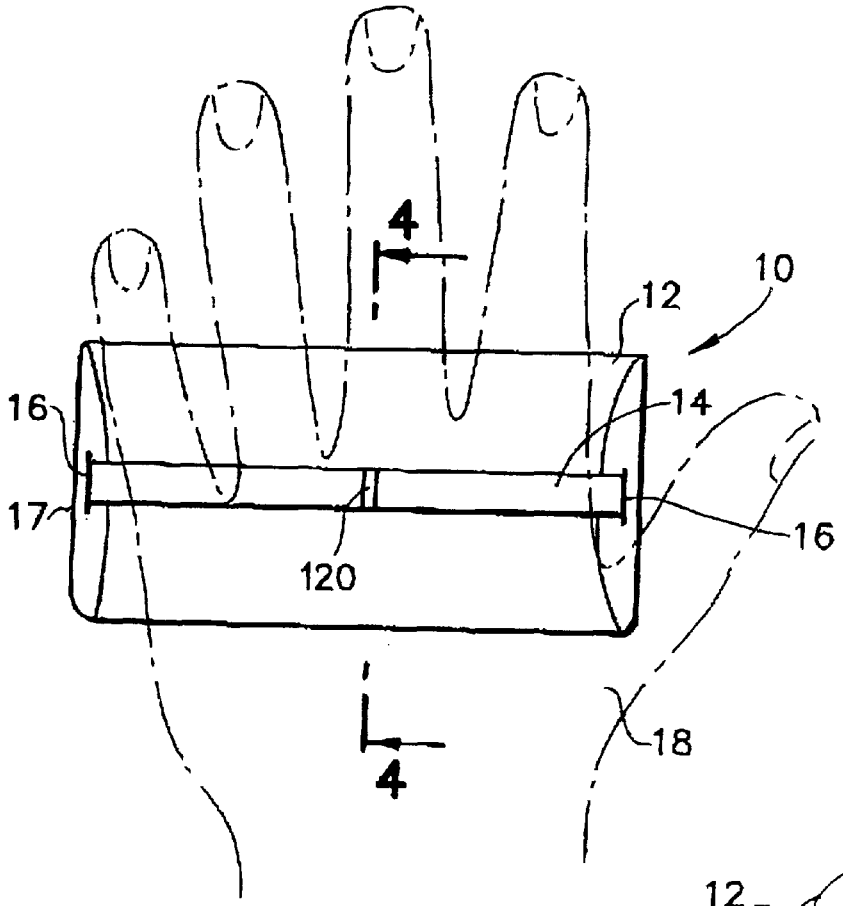
FIG. 1 is a perspective view of the inventive hand supported headrest pillow positioned on a user's hand (shown in phantom)
Figure 4:
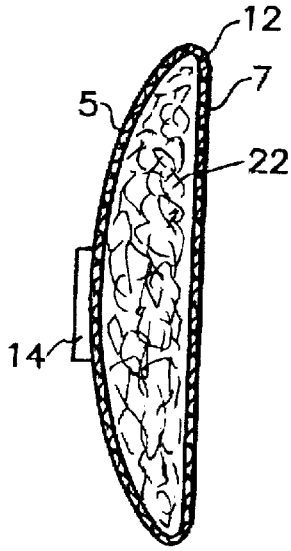
FIG. 4 is a cross-sectional view of the pillow of FIG. 1 taken along the lines 4—4.

A hand supported headrest pillow 10 in accordance with a currently preferred embodiment of the present invention is illustrated in FIG. 1. As there shown, the pillow 10 includes a cushion 12 and a means 14 for releasably securing the cushion 12 to or about a user's hand 18. Cushion 12 may be configured in any known shape such as a square, rectangle, circle, etc. and is dimensioned for at least partial seating on and against a user's palm. In FIG. 1, and by way of example, a rectangularly shaped cushion 12 is depicted. The cushion is preferably constructed of an outer cloth covering having a first surface 5 and a second surface 7 configured to form a pocket in which a stuffing material 22 (shown in FIG. 4) is contained, as is known in the art. The stuffing is a soft, compressible and resilient material such as cotton or known substitutes including, but not limited to, down feathers, wool, foam rubber, styrofoam pellets, etc. and may comprise a multiplicity of pieces of the material or a single piece thereof. Once the pocket is stuffed, it is closed as by sewing, or by operation of a zipper, snaps, or mating hook and loop fasteners. Alternatively, the cushion can be integrally formed in its entirety of foam rubber or other soft and pliable moldable material as is known in the art.

As stated above, the inventive hand-supported headrest pillow 10 includes securing means 14 for releasably securing the cushion 12 to and about a user's hand. In the preferred embodiment, the securing means 14 is a single-piece strap constructed of elastic material. Each end of the strap is non-releasably secured to the cushion 12 at an attachment region 16 preferably positioned between the first surface 5 and the second surface 7 such as by sewing, although other known suitable attachment techniques will be apparent to those having ordinary skill in the art. The strap is preferably attached so that it can be easily positioned on either side of the cushion to thus yield a "reversible" arrangement in which, depending on the position of the strap, either surface of the cushion may rest against a user's palm.

Figure 2:
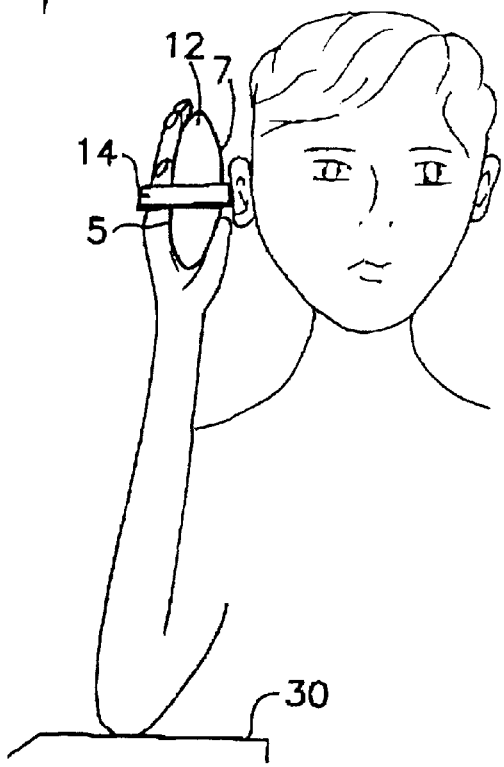
FIG. 2 is an illustration of the pillow in an intended mode of use.

To use the inventive pillow 10, the user slides his/her fingers under the strap 14 so that the strap rests on the back of the user's hand as shown in FIG. 1 and a surface of the cushion 12 is positioned against the user's palm. The elasticity of the strap 14 is selected to accommodate a variety of hand sizes and to removably secure the cushion 12 in the intended position. In a preferred embodiment, this causes the surface facing away from the user's palm (e.g., surface 7 in FIG. 2) to bulge outwardly away from a plane substantially containing the user's hand to yield a comfortable and supportive surface. The inventive pillow can then be used as a headrest, as for example shown in FIG. 2 by supporting the user's elbow on a surface 30 (e.g., an arm rest of a bus or train seat, a desk, etc.) and resting the user's head against the cushion 12.

In an alternate embodiment, strap 14 may be rendered adjustable in a two-piece design that incorporates a user-selectable coupling means 20 for attaching the loose ends of the strap 14 as shown. The coupling means may for example take the form of one or more snaps, buttons, mating hook and loop fasteners, or other types of easily securable fasteners known in the art and provide for user manipulatable adjustment of the strap length about the user's hand.

Figure 3:
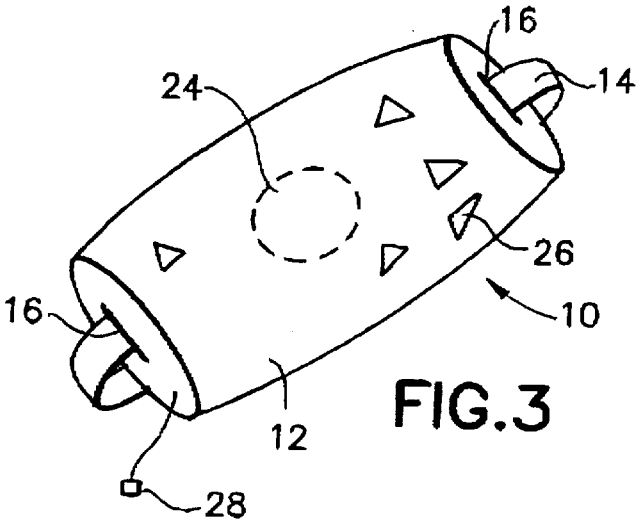
FIG. 3 is a perspective view of the headrest pillow depicting an additional feature of the present invention.

With reference now to FIG. 3, the pillow 10 may optionally include predetermined design motifs or surface features 26, for example, as cartoon characters, advertisements, etc. that are printed or sewn into or otherwise defined on the fabric from which the cushion 12 is made. In a preferred motif-bearing embodiment, each side of the cushion will contain a different design or motif. Thus, by varying the orientation of the strap 14, the user may select which of the designs will be visible for resting against a user's head. Similarly, when the surface features are configured to project even slightly outward from the fabric or cushion surface in a configured or raised stitched design, the user may select a desired one of the cushion sides against which to rest the user's head to provide a soothing or other effect provided by contact with the design.

Additionally, the pillow 10 may optionally include an integral audio transducer such as a speaker 24 contained or positioned within the cushion 12. The speaker will be interfaced—as through connection to a jack 28 or other connector switchably accessible at or proximate the cushion surface—with an external audio source (not shown) such as a portable sound source (e.g., a cassette or compact disk player or radio, etc.) connectable to the speaker interface jack 28. When so connected to an external audio source, secured to a user's hand and positioned against a user's head, as for example shown in FIG. 2, the pillow 10 will concurrently provide the user with a comfortable position of rest and an accompanying, preferably soothing or relaxing audio signal that can be heard by the user through the pillow but that will not disturb others proximate the user.

Figure 5:
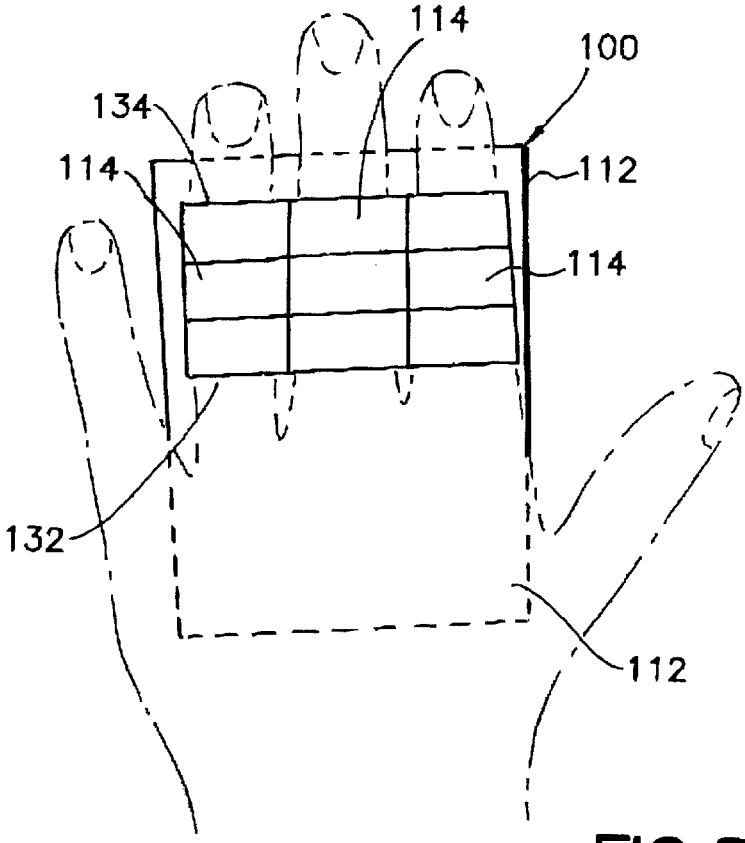
FIG. 5 depicts an alternate embodiment of the present invention.

Turning now to FIG. 5, an alternate embodiment hand supported headrest pillow 100 is there depicted. Pillow 100, like pillow 10 depicted in FIGS. 1–4, includes a cushion 112 and securing means 114 for releasably attaching the cushion 112 to a user's hand 118. As an alternative to the strap depicted in FIG. 1, one or more sheaths or sleeves 114 is provided on or mounted to a surface of cushion 112. The sheaths 114 have an entry end 132 and a far end 134 and are dimensioned for accommodating insertion therein of one or more of the user's fingers, as for example in the manner shown in FIG. 5. The sheaths 114 are preferably constructed of a cloth material and are attached to the cushion surface as by sewing, etc. The far ends 134 of the sheaths are preferably open so that the location of cushion 112 can be varied or adjusted on and along the user's palm by simply changing the depth of insertion of the user's fingers within the sheaths in a known manner.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A hand supported headrest pillow for providing a headrest for a user's head, comprising:

a cushion dimensioned for placement against a palm of a user's hand so that at least a portion of said cushion seats against the user's palm;

means for releasably securing said cushion to and against the user's palm so that with said cushion secured to the user's palm and an elbow of the user positioned on a support surface so that the user's hand is positioned to orient said cushion toward a region of the user's head, the user's head can be rested supportedly against said cushion and a sound transducer contained within said cushion, and an interface jack for connecting said sound transducer to an audio source for broadcasting an audio signal from the audio source through said cushion.

2. The headrest pillow of claim 1, wherein said transducer comprises a speaker.

3. The headrest pillow of claim 1, wherein said strap is elastic.

4. The headrest pillow of claim 1, wherein said securing means comprises a strap attached to said cushion.

5. The headrest pillow of claim 4, wherein said cushion has a first main surface and a second main surface and wherein said strap is attached to said cushion and positionable so that either of said first and said second main surfaces can be rested against the user's palm when the cushion is secured to the user's palm.

6. The headrest pillow of claim 5, wherein said first and said second main surfaces contain visible indicia.

7. The headrest pillow of claim 1, wherein said cushion comprises stuffing material and an outer covering surrounding and containing said stuffing material.

8. The headrest pillow of claim 1, wherein said securing means comprises a sheath connected to an outer surface of said cushion and dimensioned for seating about a user's finger so that with the user's finger contained within the sheath, at least a portion of said cushion is positioned against the user's palm.

9. A hand supported headrest pillow for seating against a portion of a user's head when said pillow is secured to a user's hand and a user's head is supported by the user's hand, comprising:

a cushion dimensioned for partially seating against the palm of the user's hand, said cushion comprising a stuffing material surrounded by an outer covering, said outer covering having a palm contact surface and a head contact surface;

a strap connected to said outer covering and extending across said outer covering along said palm contact surface so that when said strap is positioned across the back of a user's hand and the palm contact surface is thereby placed in contact with the user's palm, the user's head can be laid supportedly against said cushion; and a speaker contained within said cushion, and an interface jack for connecting the speaker to an audio source for broadcasting an audio signal from the audio source through said cushion.

10. The headrest pillow of claim 9, wherein said strap is adjustable in length.

* * * * *